US010480831B2

(12) United States Patent
Jonsson et al.

(10) Patent No.: US 10,480,831 B2
(45) Date of Patent: Nov. 19, 2019

(54) COMPRESSOR BEARING COOLING

(71) Applicant: Carrier Corporation, Farmington, CT (US)

(72) Inventors: Ulf J. Jonsson, South Windsor, CT (US); Vishnu M. Sishtla, Manlius, NY (US); Zaffir A. Chaudhry, South Glastonbury, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 449 days.

(21) Appl. No.: 14/779,155

(22) PCT Filed: Jan. 27, 2014

(86) PCT No.: PCT/US2014/013155

§ 371 (c)(1),
(2) Date: Sep. 22, 2015

(87) PCT Pub. No.: WO2014/158329

PCT Pub. Date: Oct. 2, 2014

(65) Prior Publication Data

US 2016/0047575 A1 Feb. 18, 2016

Related U.S. Application Data

(60) Provisional application No. 61/805,055, filed on Mar. 25, 2013.

(51) Int. Cl.
*F25B 1/053* (2006.01)
*F25B 31/00* (2006.01)
(Continued)

(52) U.S. Cl.
CPC ..... *F25B 1/053* (2013.01); *F25B 31/00* (2013.01); *F25B 31/008* (2013.01); *F25B 41/00* (2013.01);
(Continued)

(58) Field of Classification Search
CPC ..... F25B 31/00; F25B 41/00; F25B 31/009; F25B 2314/0015; F25B 2314/0012; F25B 2500/16
See application file for complete search history.

(56) References Cited

U.S. PATENT DOCUMENTS 3,286,480 A * 11/1966 Papapanu ..... F25B 1/08 62/188
3,304,998 A * 2/1967 Leonard, Jr. ..... F25B 1/053 165/111
(Continued)

FOREIGN PATENT DOCUMENTS

CN 1322290 A 11/2001
CN 104105931 A 10/2014
(Continued)

OTHER PUBLICATIONS

Chinese Office Action dated Dec. 12, 2016 for Chinese Patent Application No. 201480018388.6.
(Continued)

*Primary Examiner* — Kun Kai Ma
(74) *Attorney, Agent, or Firm* — Bachman & LaPointe, P.C.

(57) ABSTRACT

A vapor compression system (20) comprises a compressor (22) having one or more bearing systems (66, 68) supporting a rotor and/or one or more working elements (44). One or more bearing feed passages (114) are coupled to the bearings to pass fluid along a supply flowpath to the bearings. A mechanical pump (130; 330) is positioned to drive fluid along the supply flowpath. An ejector (140, 150) has a motive flow inlet (142, 152) coupled to the mechanical pump to receive refrigerant from the mechanical pump.

18 Claims, 5 Drawing Sheets

(51) Int. Cl.
*F25B 41/00* (2006.01)
*F25B 25/00* (2006.01)

(52) U.S. Cl.
CPC ..... *F25B 25/005* (2013.01); *F25B 2339/047* (2013.01); *F25B 2341/0012* (2013.01); *F25B 2341/0015* (2013.01); *F25B 2400/13* (2013.01); *F25B 2500/16* (2013.01)

(56) References Cited

U.S. PATENT DOCUMENTS

| | | | | | |
|---|---|---|---|---|---|
| 3,360,958 | A * | 1/1968 | Miner | F25B 31/002 | 62/470 |
| 3,392,547 | A | 7/1968 | Hopkins | | |
| 3,742,726 | A | 7/1973 | English | | |
| 4,032,312 | A | 6/1977 | Anderson | | |
| 4,523,437 | A | 6/1985 | Briley | | |
| 5,133,324 | A | 7/1992 | Michiaki | | |
| 5,165,248 | A * | 11/1992 | Sishtla | F04D 29/063 | 62/193 |
| 5,309,736 | A | 5/1994 | Kowalski et al. | | |
| 6,065,297 | A * | 5/2000 | Tischer | F04D 29/063 | 62/471 |
| 6,182,467 | B1 * | 2/2001 | Zhong | F04C 29/025 | 62/470 |
| 6,216,474 | B1 * | 4/2001 | Sishtla | F04C 28/08 | 62/193 |
| 6,237,353 | B1 * | 5/2001 | Sishtla | F25B 31/008 | 62/238.6 |
| 6,564,560 | B2 * | 5/2003 | Butterworth | F04D 29/023 | 62/259.2 |
| 6,739,147 | B1 * | 5/2004 | Sishtla | F04C 29/026 | 62/192 |
| 7,726,150 | B2 | 6/2010 | Nishijima et al. | | |
| 8,186,180 | B2 | 5/2012 | Oshitani et al. | | |
| 9,732,997 | B2 * | 8/2017 | Sishtla | F16J 15/002 | |
| 2003/0070878 | A1 * | 4/2003 | Zhong | F04C 18/165 | 184/6.16 |
| 2008/0210601 | A1 * | 9/2008 | Shoulders | F25B 31/004 | 208/184 |
| 2008/0245082 | A1 * | 10/2008 | Sishtla | F04D 29/058 | 62/84 |
| 2010/0186410 | A1 * | 7/2010 | Cogswell | F01D 25/18 | 60/671 |
| 2011/0036781 | A1 | 2/2011 | Clements et al. | | |
| 2012/0036854 | A1 | 2/2012 | Vaisman et al. | | |
| 2012/0116594 | A1 | 5/2012 | Aidoun et al. | | |
| 2012/0219431 | A1 * | 8/2012 | Sishtla | F04D 27/0246 | 417/53 |
| 2012/0234026 | A1 * | 9/2012 | Oh | F25B 9/008 | 62/115 |
| 2012/0312379 | A1 * | 12/2012 | Gielda | F25B 41/00 | 137/1 |
| 2013/0104593 | A1 * | 5/2013 | Occhipinti | F25B 5/02 | 62/498 |
| 2013/0156544 | A1 * | 6/2013 | Sishtla | F04D 27/0261 | 415/1 |
| 2013/0302184 | A1 * | 11/2013 | Sishtla | F04D 13/0606 | 417/53 |
| 2014/0047855 | A1 * | 2/2014 | Kolarich | F25B 49/02 | 62/129 |
| 2014/0360210 | A1 * | 12/2014 | Lapp | F25B 1/053 | 62/84 |
| 2016/0040915 | A1 * | 2/2016 | Jonsson | F25B 1/053 | 62/498 |
| 2016/0054040 | A1 * | 2/2016 | Jonsson | F25B 1/053 | 62/115 |

FOREIGN PATENT DOCUMENTS

| | | | |
|---|---|---|---|
| EP | 1087190 | A1 | 3/2001 |
| EP | 1400765 | A2 | 3/2004 |
| EP | 1440765 | A1 | 7/2004 |
| EP | 1614982 | A2 | 1/2006 |
| GB | 662563 | | 12/1951 |

OTHER PUBLICATIONS

International Search Report and Written Opinion for PCT/US2014/013155, dated May 8, 2014.

Steam-jet air ejectors (SJAE) Enggcyclopedia, downloaded Feb. 1, 2013, http://www.enggcyclopedia.com/2012/03/steam-ejectors.

* cited by examiner

COMPRESSOR BEARING COOLING

CROSS-REFERENCE TO RELATED APPLICATION

Benefit is claimed of U.S. Patent Application Ser. No. 61/805,055, filed Mar. 25, 2013, and entitled "Compressor Bearing Cooling".

BACKGROUND

The disclosure relates to vapor compression systems. More particularly, the disclosure relates to such systems having electric motor-driven compressors.

One particular use of electric motor-driven compressors is liquid chillers. An exemplary liquid chiller uses a semi-hermetic centrifugal compressor. The exemplary unit comprises a standalone combination of the compressor, a condenser unit, an evaporator unit, an expansion device, and various additional components. Some such exemplary compressors include a transmission intervening between the motor rotor and the impeller to drive the impeller at a faster speed than the motor.

In various compressors, the motor may be exposed to a bypass of refrigerant flow to cool the motor and/or lubricate bearings.

In most refrigeration systems (especially those using screw compressors and reciprocating compressors), a lubricant (e.g., oil) is added to the refrigerant. The oil may be selectively separated from the refrigerant flow and reintroduced for lubrication (e.g., separated in a mechanical separator or still and then returned to lubrication ports along the bearings. Other compressors (especially centrifugal compressors) are oil-free. In such oil-free compressors, refrigerant itself may be directed to the bearings to cool and lubricate the bearings. Exemplary bearings are ball bearing-type bearings where the balls are made from ceramic materials. The refrigerant may be drawn by a mechanical pump for delivery to the bearings.

In such oil-free compressors, providing startup lubrication has posed problems. Depending upon operational conditions, the inlet port of a mechanical pump may be non-advantageously positioned to provide refrigerant. U.S. Pat. No. 6,654,560 discloses a dual-impeller pump wherein one impeller is positioned to draw from the evaporator and another impeller is positioned to draw from the condenser.

SUMMARY

One aspect of the disclosure involves a vapor compression system comprising a compressor comprising a housing assembly having a suction port and a discharge port and a motor compartment. An electric motor has a stator within the motor compartment and a rotor within the stator. The rotor is mounted for rotation about a rotor axis. One or more working elements are coupled to the rotor to be driven by the rotor in at least a first condition so as to draw fluid in through the suction port and discharge said fluid out from the discharge port. One or more bearing systems support the rotor and/or the one or more working elements. One or more bearing feed passages are coupled to the bearings to pass fluid along a supply flowpath to the bearings. A mechanical pump is positioned to drive fluid along the supply flowpath to the one or more bearings. A first heat exchanger is downstream of the discharge port along a refrigerant primary flowpath. In at least a first operational mode, an expansion device is downstream of the first heat exchanger along the primary flowpath in the first operational mode. A second heat exchanger is downstream of the expansion device and coupled to the suction port to return refrigerant. In the first operational mode, the system further comprises an ejector having a motive flow inlet coupled to the mechanical pump to receive refrigerant from the mechanical pump, a suction flow inlet, and an outlet.

In additional or alternative embodiments of any of the foregoing embodiments, a discharge flowpath from the ejector outlet at least partially feeds back to the mechanical pump.

In additional or alternative embodiments of any of the foregoing embodiments, the supply flowpath passes through the ejector from the suction flow inlet to the outlet in at least one operational condition.

In additional or alternative embodiments of any of the foregoing embodiments, a suction flowpath of the ejector extends from the second heat exchanger to the ejector suction flow inlet.

In additional or alternative embodiments of any of the foregoing embodiments, a motive flowpath of the ejector branches from the supply flowpath downstream of the pump and extends to the motive flow inlet.

In additional or alternative embodiments of any of the foregoing embodiments, the ejector is a first ejector and the system further comprises a second ejector. The second ejector has a motive flow inlet, a suction flow inlet, and an outlet. A motive flowpath of the second ejector branches from the supply flowpath downstream of the pump and extends to the second ejector motive flow inlet. A suction flowpath of the second ejector extends from the second heat exchanger to the second ejector suction flow inlet. An outlet flowpath of the second ejector feeds back from the second ejector outlet to the first ejector suction flow inlet.

In additional or alternative embodiments of any of the foregoing embodiments, the first ejector motive flow inlet receives fluid from the first heat exchanger and the second ejector outlet flowpath feeds back to the first heat exchanger.

In additional or alternative embodiments of any of the foregoing embodiments, the first ejector motive flow inlet receives fluid from a sump of the first heat exchanger and the second ejector outlet flowpath feeds back to the sump.

In additional or alternative embodiments of any of the foregoing embodiments, the compressor is a centrifugal compressor and the one or more working elements comprise one or more impellers.

In additional or alternative embodiments of any of the foregoing embodiments, the one or more impellers is a single impeller mounted to the rotor for direct coaxial rotation therewith.

In additional or alternative embodiments of any of the foregoing embodiments, one or more bearing drain passages are positioned to pass said fluid to a suction housing plenum.

In additional or alternative embodiments of any of the foregoing embodiments, one or more bearing drain passages are positioned to pass said fluid to the second heat exchanger.

In additional or alternative embodiments of any of the foregoing embodiments, one or more of: the system is a chiller; the system has a refrigerant charge selected from the group consisting of low pressure refrigerants and medium pressure refrigerants; the system has a refrigerant charge selected from the group consisting of HFC refrigerants and HFO refrigerants; the system has a refrigerant charge selected from the group consisting of R1233zd, R1234yf, R1234ze, and R134a; and the mechanical pump is a gear pump, a centrifugal pump, a regenerative pump, a screw pump, or a vane pump.

In additional or alternative embodiments of any of the foregoing embodiments, the system further comprises a controller configured to start the mechanical pump prior to starting the compressor.

In additional or alternative embodiments of any of the foregoing embodiments, the controller is configured to turn off the mechanical pump and leave the compressor running when a threshold condition has been sensed.

In additional or alternative embodiments of any of the foregoing embodiments, a method for operating the system comprises: starting the mechanical pump; after the starting of the mechanical pump, starting the motor to draw the fluid in through the suction port and discharge the fluid from the discharge port; and turning the mechanical pump off while continuing to run the motor.

In additional or alternative embodiments of any of the foregoing embodiments, the motor is started after a first threshold condition is sensed, and the mechanical pump is turned off after a second threshold condition is sensed.

In additional or alternative embodiments of any of the foregoing embodiments, a flow or pressure parameter is monitored and, responsive to said parameter indicating an insufficiency of flow, the mechanical pump is restarted while continuing the run the motor.

In additional or alternative embodiments of any of the foregoing embodiments, the mechanical pump is restarted while continuing to run the motor, the motor is turned off while continuing to run the mechanical pump, and the mechanical pump is turned off after turning the motor off.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
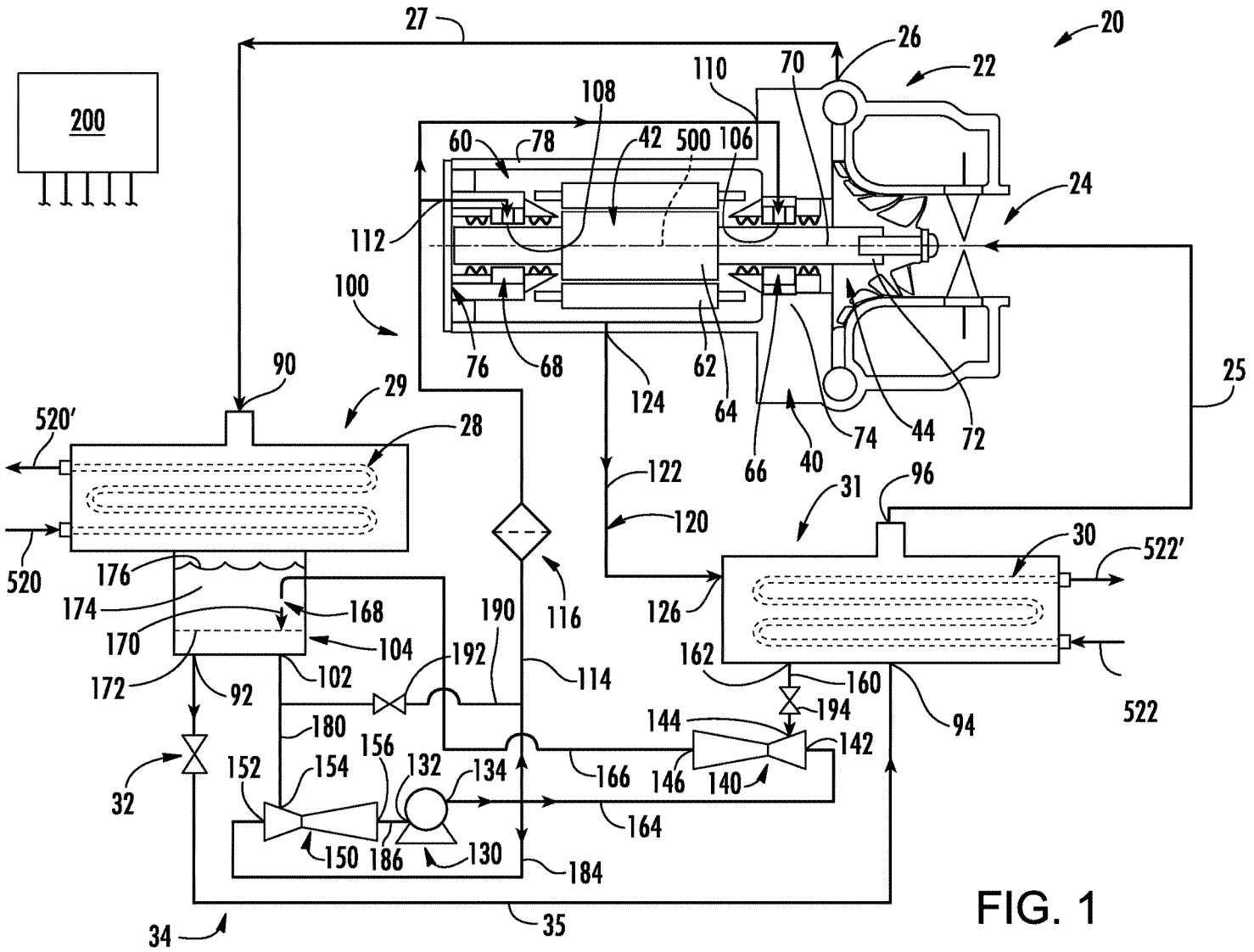
FIG. 1 is a partially schematic view of a chiller system.

FIG. 1 shows a vapor compression system 20. The exemplary vapor compression system 20 is a chiller system. The system 20 includes a compressor 22 having a suction port (inlet) 24 fed by a suction line 25 and a discharge port (outlet) 26 feeding a discharge line 27. The system further includes a first heat exchanger 28 in a normal operating mode being a heat rejection heat exchanger (e.g., a gas cooler or condenser). In an exemplary system based upon an existing chiller, the heat exchanger 28 is a refrigerant-water heat exchanger in a condenser unit 29 where the refrigerant is cooled and condensed by an external water flow 520 (inlet), 520' (outlet).

The system further includes a second heat exchanger 30 (in the normal mode a heat absorption heat exchanger or evaporator). In the exemplary system, the heat exchanger 30 is a refrigerant-water heat exchanger for chilling a chilled water flow 522 (inlet), 522' (outlet) within an evaporator unit 31. An expansion device 32 (e.g., an electrically controlled valve, a fixed orifice, or a float-controlled valve) is downstream of the heat rejection heat exchanger and upstream of the heat absorption heat exchanger 30 along the normal mode main refrigerant flowpath 34 (the flowpath being partially surrounded by associated piping, etc. and including the suction line 25, discharge line 26, and intermediate line 35). The exemplary refrigerant-water heat exchangers 28 and 30 comprise tube bundles carrying water flow and in heat exchange relation with refrigerant passing around the bundles within the shells of the units 29 and 31. The water inlets and outlets of the heat exchangers are shown unnumbered.

An exemplary compressor is a centrifugal compressor having a housing assembly (housing) 40. The housing assembly contains an electric motor 42 and one or more working elements 44 (impeller(s) for a centrifugal compressor; scroll(s) for a scroll compressor; or piston(s) for a reciprocating compressor) drivable by the electric motor in the first mode to draw fluid (refrigerant) in through the suction port, compress the fluid, and discharge the fluid from the discharge port. The exemplary centrifugal working element(s) comprise a rotating impeller directly driven by the motor about an axis 500. Alternative centrifugal compressors may have a transmission coupling the motor to the impeller(s).

The housing defines a motor compartment 60 containing a stator 62 of the motor within the compartment. A rotor 64 of the motor is partially within the stator and is mounted for rotation about a rotor axis 500. The exemplary mounting is via one or more bearing systems 66, 68 mounting a shaft 70 of the rotor to the housing assembly. The exemplary impeller 44 is mounted to the shaft (e.g., an end portion 72) to rotate therewith as a unit about the axis 500. The exemplary bearing system 66 mounts an intermediate portion of the shaft to an intermediate wall 74 of the housing assembly. The exemplary bearing system 68 mounts an opposite end portion of the shaft to an end wall/cover portion 76 of the housing assembly. Between the walls 74 and 76, the housing includes an outer wall 78 generally surrounding the motor compartment.

The exemplary system supplies refrigerant to cool the motor and/or cool or lubricate bearings. The exemplary system is an "oil-free" system. This does not preclude presence of small amounts of oil. For example, a traditional oil-lubricated chiller may have lubrication/cooling flows that are in excess of 70% oil by weight. In contrast, the exemplary system has flows that will be much more than 50% refrigerant by weight, more particularly in excess of 70% refrigerant by weight (less than 30% oil by weight) or more than 90%, 95%, or 99% refrigerant by weight. Introduction of oil may plug evaporator tubes and reduce heat transfer in the evaporator. With oil concentrations below 1% there is likely to be essentially no interference with heat transfer in the evaporator.

FIG. 1 shows the condenser having a primary inlet 90 and a primary outlet 92. Similarly, the evaporator has a primary inlet 94 and a primary outlet 96. FIG. 1 further shows a supply flowpath 100 for delivering refrigerant to the bearings. The exemplary supply flowpath extends from condenser 28 (a second outlet 102 of the condenser unit 29 in the exemplary refrigerant-water heat exchanger 28). Flowpath 100 extends to ports 106, 108 at the bearings 66 and 68. Flowpath 100 may enter one or more ports 110, 112 along the compressor housing (e.g., fed by branches of a supply line 114). Along the exemplary supply line 114 is a filter 116 (an alternative filter location being immediately downstream of the pump outlet 134 prior to any branching of flows). This diverted flow of refrigerant may be returned to the main flowpath via a return flowpath or branch 120. The flowpath 120 may extend along a line 122 extending from a port 124 along the motor case to a port 126 at the heat rejection heat exchanger 30 (the unit 31 in the example of a refrigerant-water heat exchanger). In the illustrated example, the port 124 is open directly to the motor compartment 60 to collect refrigerant which may have bypassed seals adjacent the bearings. Alternative implementations may include return passageways extending through the housing to the bearings themselves.

To drive the supply flow, there is a mechanical pump 130. Exemplary mechanical pumps are centrifugal pumps or gear pumps with an electric motor driving the respective impeller or gears. The exemplary pump 130 has an inlet port 132 and an outlet port 134.

FIG. 1 further shows two ejectors 140 and 150 used to assist in the supply of refrigerant to the bearings. Each of the ejectors has a motive flow inlet or primary inlet 142, 152, a secondary inlet or suction inlet 144, 154, and an outlet 146, 156.

The ejector 140 has a suction line 160 extending from a port 162 on the heat exchanger unit 31 to draw a suction flow off of the main flowpath. The motive flow for the ejector 140 is provided by the pump 130 via a line 164 branching off the supply flowpath between the pump outlet port 134 and the bearings. The combined discharged flow of the ejector 140 is delivered via a line 166 back to one or both of: (a) the supply flowpath 100 upstream of the pump 130; (b) or the main flowpath 34 (e.g., upstream of the expansion device 32). In this example, the line 166 extends to an outlet 168 in the sump 104 to discharge the combined flow 170 just upstream of where the supply flowpath 100 branches off the main flowpath 34. The exemplary sump includes a screen 172 below/downstream of the outlet 160. A liquid refrigerant accumulation 174 may occupy the sump extending upward to a surface 176 in the sump or in the body of the heat exchanger 28/unit 29. The sump may include a float valve (not shown).

In a similar fashion to the ejector 140, the motive port 152 of the ejector 150 may receive flow via a line 184 that also branches from the supply flowpath downstream of the pump 130. The suction flow is drawn via a line 180 extending from the port 102 to the suction port 154. The combined discharge flow is delivered via line 186 to the port 132. As is discussed further below, additional means may be provided for influencing flow through the ejectors. These may include valves positioned to control one or more flows through the ejector and/or bypass the ejector. In the FIG. 1 example, a bypass line 190 extends between the lines 180 and 114 to bypass the ejector 150 and pump 130. A valve 192 may be located along the line or at one of its ends to control flow therethrough. Additionally, a valve 194 is located in the line 160 to selectively control the suction flow of the ejector 140. The line 190 may have alternative origins such as the line 35 or the sump 104. Yet alternative means for delivering flow without pumping by the pump or ejectors may be provided.

FIG. 1 further shows a controller 200. The controller may receive user inputs from an input device (e.g., switches, keyboard, or the like) and sensors (not shown, e.g., pressure sensors and temperature sensors at various system locations). The controller may be coupled to the sensors and controllable system components (e.g., valves, the bearings, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

As is discussed further below, one or both of these ejectors may be omitted. For example, system 220 of FIG. 2 eliminates the ejector 150. FIG. 3 shows an alternative embodiment 320 where the pump is mounted with its inlet directly on the bottom of the condenser sump. The exemplary pump is a centrifugal pump having an inducer co-rotating with its impeller immediately upstream thereof.

The ejectors serve to ensure pump operation to supply refrigerant to the bearings in particular conditions. One exemplary condition is a startup condition. In the startup condition, there may be one or more properties of refrigerant in the condenser sump which could adversely affect operation of at least some forms of and positionings of pump.

In one or more exemplary startup conditions, the ejector 140 may serve to transport liquid refrigerant from the evaporator to the condenser in order to then be pumped by the mechanical pump. In an exemplary water-cooled chiller, it is likely that the water in the evaporator is colder than the water in the condenser. This results in refrigerant condensing and migrating to the evaporator. Even if there is sufficient initial liquid in the sump (often the case where the sump is the lowest part of the system) to prime the pump, that small amount of liquid can be quickly expended. Thus, the ejector 140 helps quickly replenish this refrigerant to provide further refrigerant to be pumped to the bearings and provide continuous refrigerant supply to the bearings.

In one or more exemplary startup situations, the ejector 150 may serve to prevent cavitation of the mechanical pump. At start-up, all the liquid refrigerant is normally at or near saturation. If there is some increase in temperature in the pump, the pump can vapor lock (e.g., refrigerant entering the pump boils so that the pump stops working). The ejector 150 thus helps feed refrigerant to the mechanical pump to prevent vapor locking. The relative importance of this ejector may depend on factors such as pump positioning and pump configuration. Centrifugal pumps are less prone to vapor lock than gear pumps. Thus, the ejector 150 may be particularly useful with a gear pump. Additionally, proximity of the pump to the sump may reduce chances of cavitation. Thus, the FIG. 3 embodiment orients a centrifugal pump 330 (e.g., having an electric motor 331) impeller-up with the pump inlet 332 along the bottom of the sump in order to easily obtain the liquid refrigerant. FIG. 3A shows the pump 330 as having an outlet 334. Bearing lubrication for the bearings 340 of the pump may be provided via passageways 342 branching from the line 180 or more directly from a discharge plenum 344 or other portion of the pump. Refrigerant may be withdrawn from the bearings by one or more passageways 350. In the exemplary embodiment, the passageways 350 return refrigerant to a port 352 upstream of the impeller 354 (e.g., upstream of or along the inducer 356).

Figure 4:
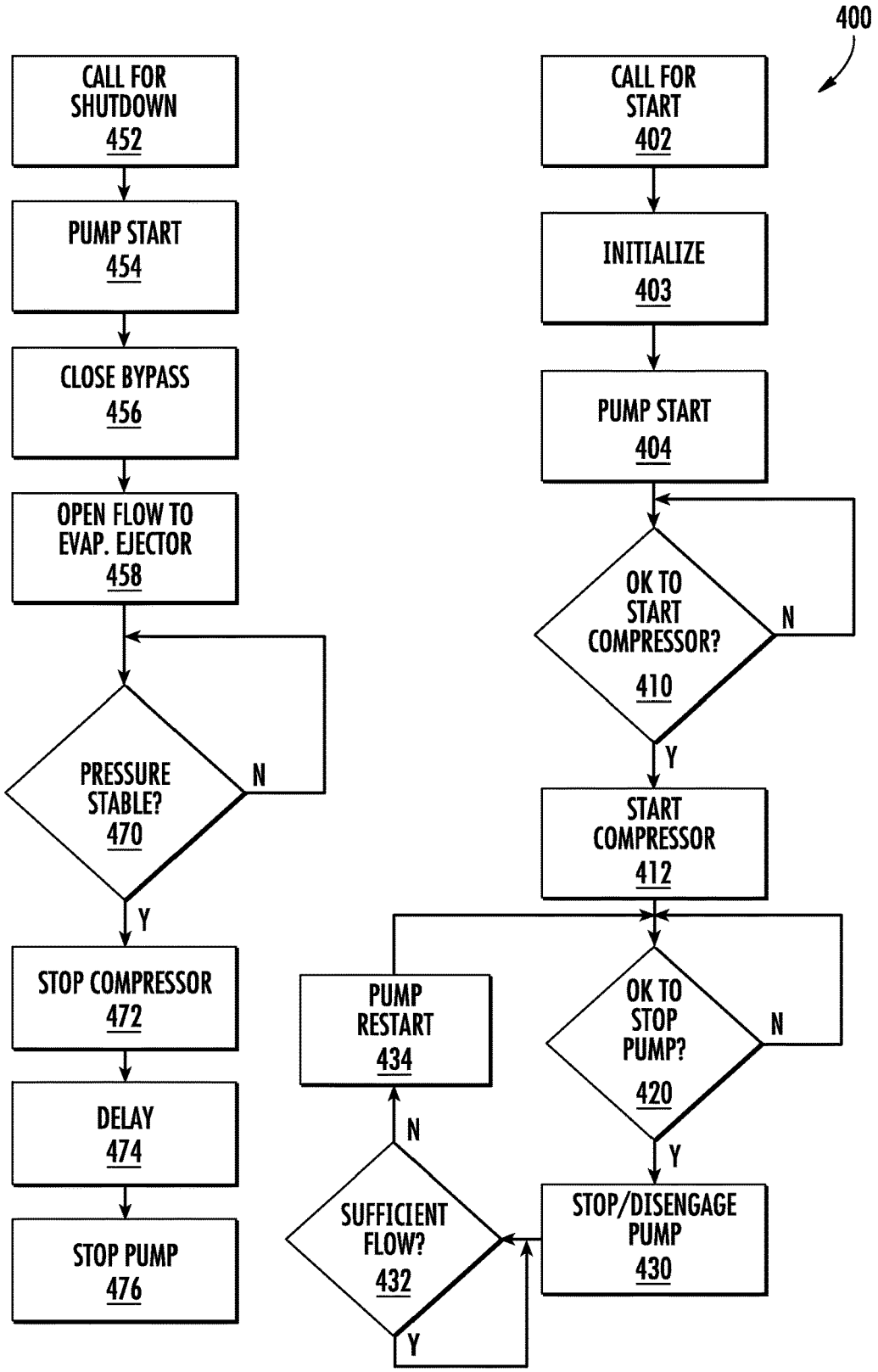
FIG. 4 is a simplified control flowchart.

FIG. 4 shows an exemplary sequence 400 of operations. An initial call for start 402 is made (e.g., manually entered or made as a decision by the controller). Upon the call for start, an initialization 403 may be performed (e.g., if not already in these conditions, the valve 194 is opened and the valve 192 is closed). The controller then starts 404 the pump.

This causes a pressure rise and induces motive flow in the ejector(s). This causes flow into the condenser via the line 166.

Various system conditions (e.g., pressures) may be continuously monitored. An exemplary pressure monitoring 410 used to determine compressor start comprises determining whether there is sufficient fluid pressure delivered to the bearings or fluid flow delivered to the bearings. In one example, the pressure in line 114 is measured by a sensor (not shown) and compared with the evaporator pressure measured by another sensor (not shown). If the line pressure exceeds the evaporator pressure by a first threshold, the compressor is started 412. Otherwise, there is a delay and the decision is repeated until the condition is satisfied.

It may next be determined 420 whether there is sufficient fluid pressure to disengage the pump. This decision may reflect a similar pressure measurement. For example, sensed condenser pressure is compared with sensed evaporator pressure. If condenser pressure exceeds evaporator pressure by an appropriate threshold (which may be the same as, lesser, or greater than the first threshold) a pump disengagement (stopping) 430 occurs. An exemplary pump disengagement comprises turning off the pump motor, closing the valve 194, and opening the bypass valve 192 so that refrigerant passes directly from the condenser into the line 114 bypassing the ejector 150, pump 130, and ejector 140.

There may be continuous monitoring of flow sufficiency. This determination 432 may reflect the same or similar determination to block 420. If flow is determined insufficient, then the pump is restarted 434. The system may then return to the monitoring of block 420.

Among further options are a shutdown process which may involve altering operation of the ejectors and/or pump. In an exemplary shutdown situation there is a call for shutdown 452. This call for shutdown 452 may be initiated in any of several ways including automatic control and user command. The exemplary switching then involves starting (restarting) 454 the pump (if not already running), closing 456 the bypass valve 192, and opening 458 the valve 194 providing evaporator refrigerant to the ejector 140. These three steps are shown serially in a particular order, however, they may be performed in various combinations of simultaneously or other orders. There may some transient pressure fluctuations; therefore, a stabilization 470 may involve a set time delay or a continuous measurement of pressure and tracking of differences (shown). Upon stabilization, the compressor is shut off (turned off or stopped) 472. When the compressor stops rotating, the pump may be shut off (turned off or stopped) 476 or there may be a fixed or other delay 474.

Figure 2:
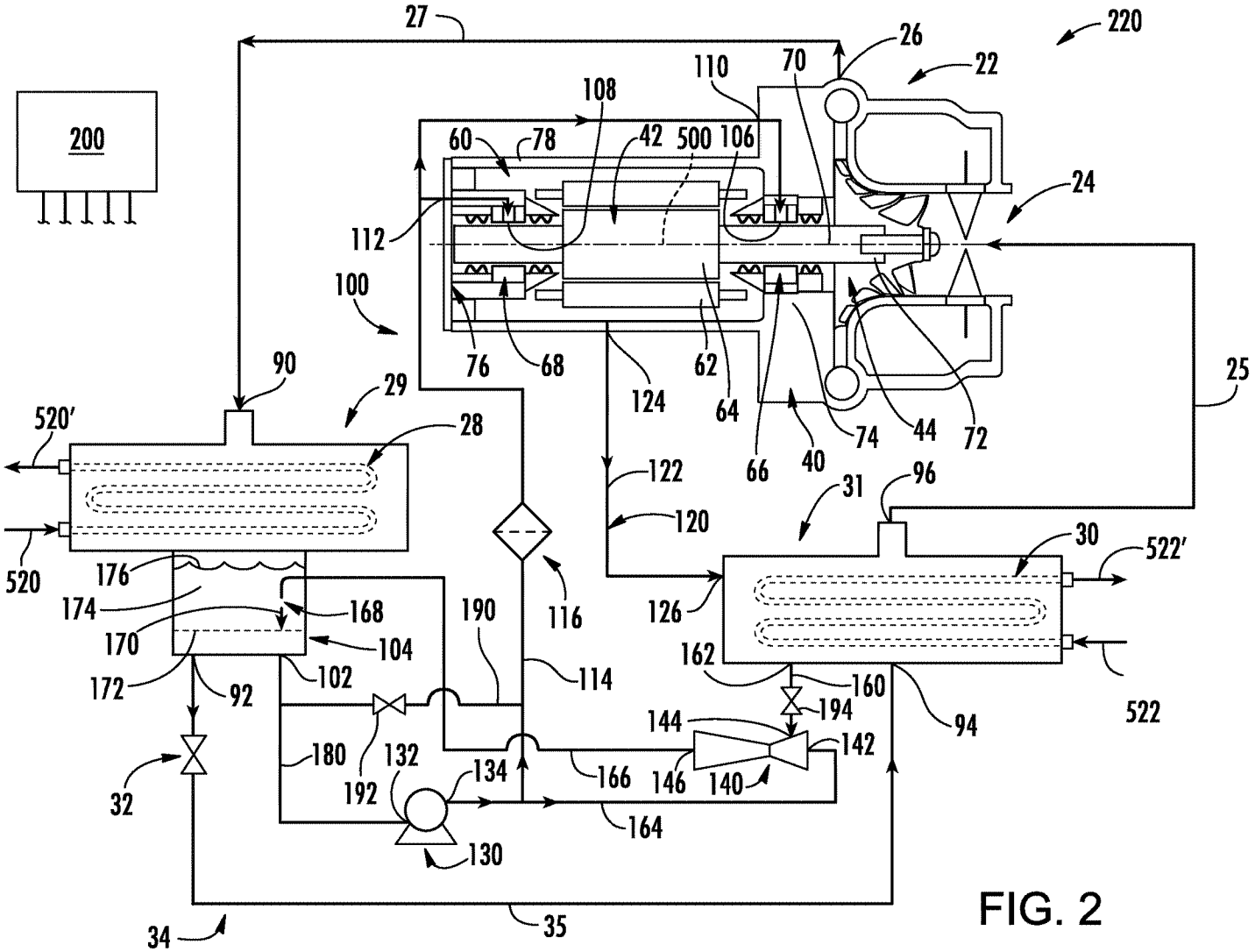
FIG. 2 is a partially schematic view of a second chiller system.
Figure 3:
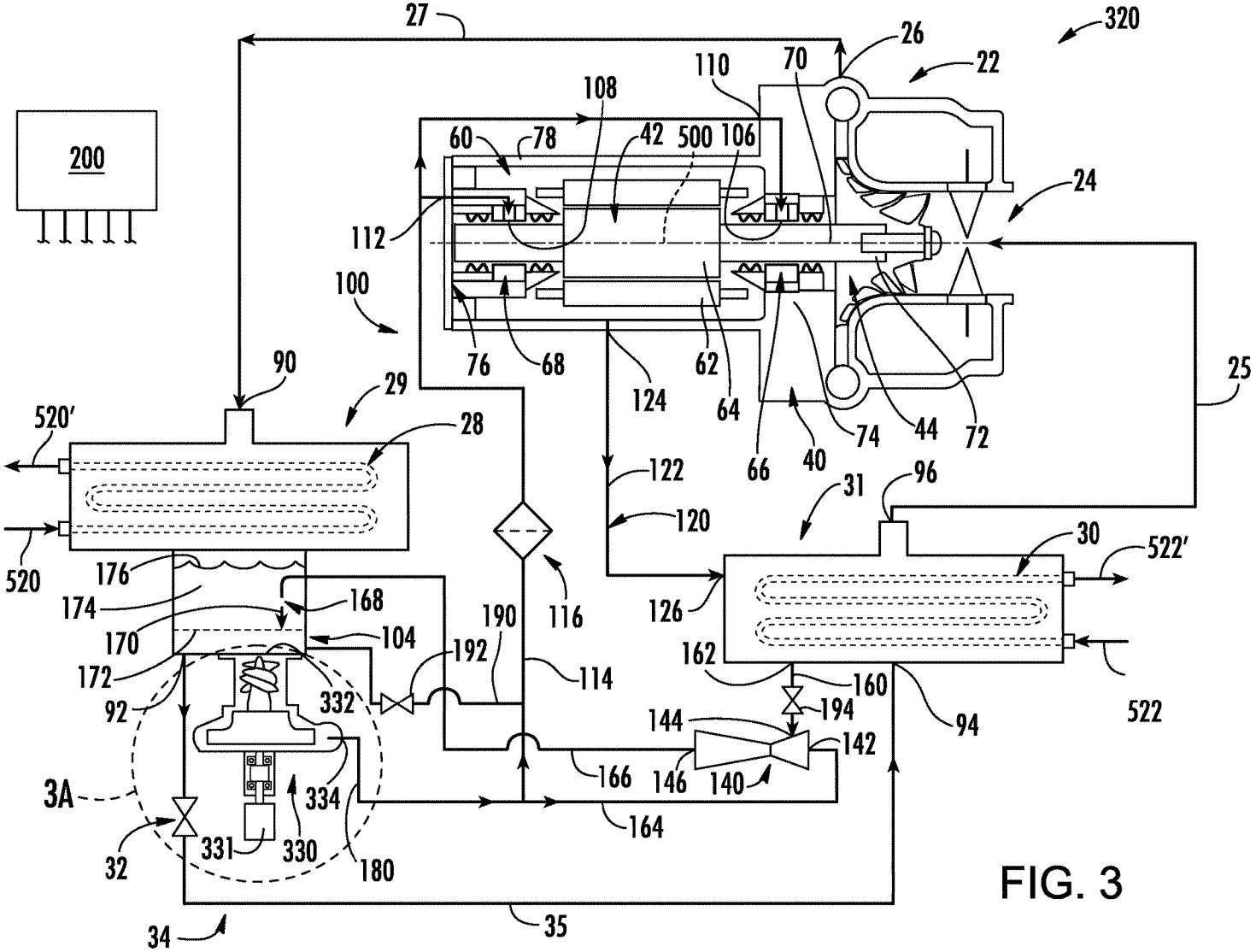
FIG. 3 is a partially schematic view of a third chiller system.
Figure 3A:
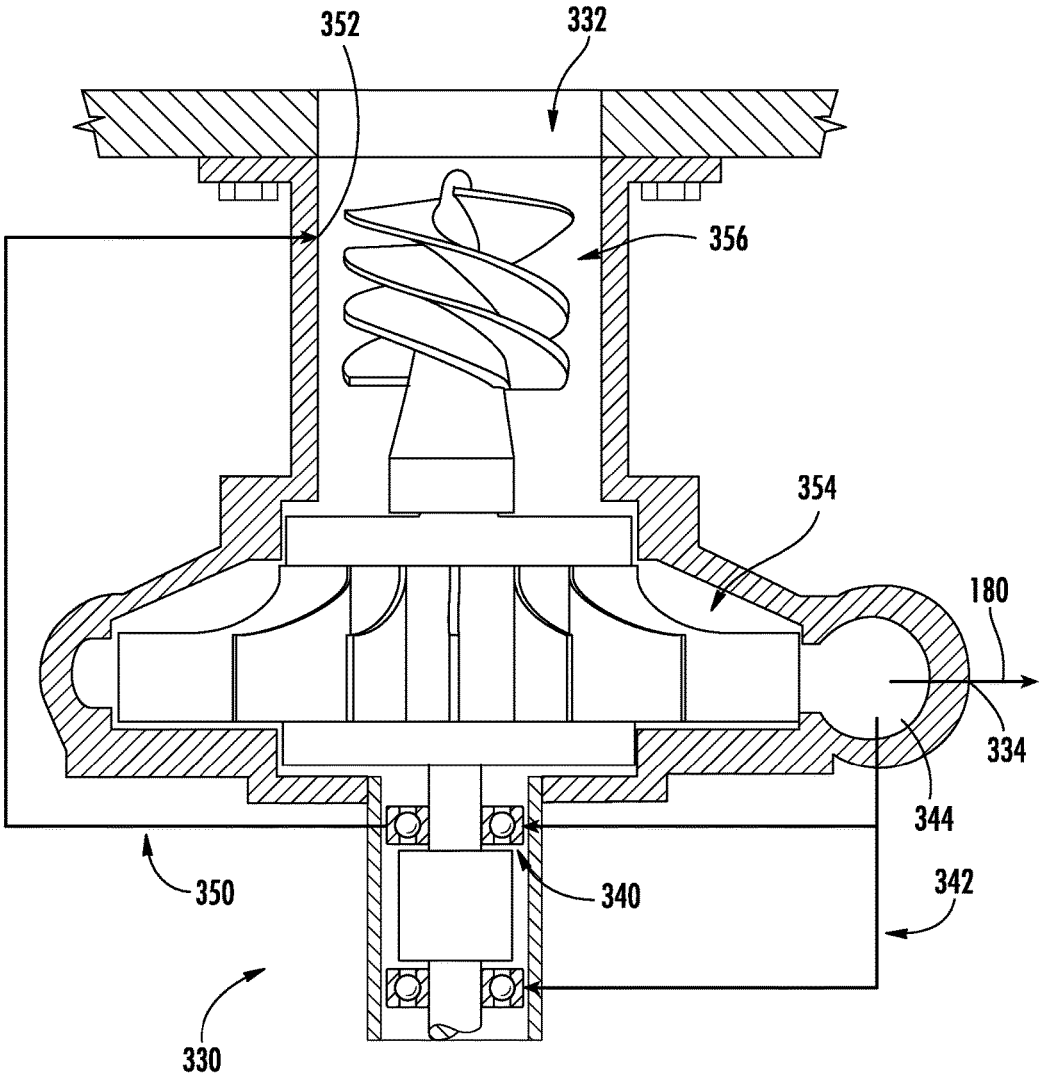
FIG. 3A is an enlarged partially schematic view of a pump of the chiller system of FIG. 3.

The same basic control may be applied to the FIGS. 2 and 3 embodiments.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

References in the claims below do not preclude integrations or separations. For example, although ejectors, lines, valves, and the like may be listed in claims in like manner to the compressor and heat exchangers, this does not preclude integration of such elements into the compressor or heat exchangers. Similarly, if the compressor is indicated as having an element, this does not require such element to be integrated with the housing of the compressor and such element might be integrated with another component while having any specified functional or communication relationship to the compressor.

Where a measure is given in English units followed by a parenthetical containing SI or other units, the parenthetical's units are a conversion and should not imply a degree of precision not found in the English units.

Although an embodiment is described above in detail, such description is not intended for limiting the scope of the present disclosure. It will be understood that various modifications may be made without departing from the spirit and scope of the disclosure. For example, when applied to the reengineering of an existing compressor or a compressor in an existing application, details of the existing compressor or application may influence details of any particular implementation. Accordingly, other embodiments are within the scope of the following claims.

What is claimed is:

1. A vapor compression system comprising:

a compressor comprising:

a housing assembly having a suction port and a discharge port and a motor compartment;

an electric motor having a stator within the motor compartment and a rotor within the stator, the rotor being mounted for rotation about a rotor axis;

one or more working elements coupled to the rotor to be driven by the rotor in at least a first condition so as to draw fluid in through the suction port and discharge said fluid out from the discharge port;

one or more bearings supporting the rotor and/or the one or more working elements, and one or more bearing feed passages coupled to the one or more bearings to pass fluid along a supply flowpath to the one or more bearings;

a mechanical pump positioned to drive fluid along the supply flowpath to the one or more bearings;

a first heat exchanger downstream of the discharge port along a refrigerant primary flowpath in a first operational mode;

an expansion device downstream of the first heat exchanger along the primary flowpath in the first operational mode; and a second heat exchanger downstream of the expansion device and coupled to the suction port to return refrigerant in the first operational mode, the vapor compression system further comprising:

one or more bearing drain passages positioned to pass a bearing drain flow of said fluid from the motor compartment to the second heat exchanger;

an ejector having:

a motive flow inlet, coupled to the mechanical pump to receive refrigerant from the mechanical pump;

a suction flow inlet; and an outlet.

2. The vapor compression system of claim 1 wherein:

a discharge flowpath from the outlet of the ejector at least partially feeds back to the mechanical pump.

3. The vapor compression system of claim 1 wherein:

the supply flowpath passes through the ejector from the suction flow inlet to the outlet in at least one operational condition.

4. The vapor compression system of claim 1 wherein:

a suction flowpath of the ejector extends from the second heat exchanger to the suction flow inlet of the ejector.

5. The vapor compression system of claim 1 wherein:
a motive flowpath of the ejector branches from the supply flowpath downstream of the mechanical pump and extends to the motive flow inlet.

6. The vapor compression system of claim 1 wherein:
the compressor is a centrifugal compressor; and
the one or more working elements comprises one or more impellers.

7. The vapor compression system of claim 6 wherein:
the one or more impellers is a single impeller mounted to the rotor for direct coaxial rotation therewith.

8. The vapor compression system of claim 1 wherein one or more of:
the vapor compression system is a chiller;
the vapor compression system has a refrigerant charge selected from the group consisting of low pressure refrigerants and medium pressure refrigerants;
the vapor compression system has a refrigerant charge selected from the group consisting of HFC refrigerants and HFO refrigerants;
the vapor compression system has a refrigerant charge selected from the group consisting of R1233zd, R1234yf, R1234ze, and R134a; and/or
the mechanical pump is a gear pump, a centrifugal pump, a regenerative pump, a screw pump, or a vane pump.

9. The vapor compression system of claim 1 further comprising:
a controller configured to:
start the mechanical pump prior to starting the compressor.

10. The vapor compression system of claim 1 wherein the fluid comprises liquid refrigerant.

11. A vapor compression system comprising:
a compressor comprising:
a housing assembly having a suction port and a discharge port and a motor compartment;
an electric motor having a stator within the motor compartment and a rotor within the stator, the rotor being mounted for rotation about a rotor axis;
one or more working elements coupled to the rotor to be driven by the rotor in at least a first condition so as to draw fluid in through the suction port and discharge said fluid out from the discharge port;
one or more bearings supporting the rotor and/or the one or more working elements, and
one or more bearing feed passages coupled to the one or more bearings to pass fluid along a supply flowpath to the one or more bearings;
a mechanical pump positioned to drive fluid along the supply flowpath to the one or more bearings;
a first heat exchanger downstream of the discharge port along a refrigerant primary flowpath in a first operational mode;
an expansion device downstream of the first heat exchanger along the primary flowpath in the first operational mode; and
a second heat exchanger downstream of the expansion device and coupled to the suction port to return refrigerant in the first operational mode, the vapor compression system further comprising:
a first ejector having:
a motive flow inlet, coupled to the mechanical pump to receive refrigerant from the mechanical pump;
a suction flow inlet; and
an outlet; and
a second ejector having:
a motive flow inlet;
a suction flow inlet; and
an outlet,
wherein:
a motive flowpath of the second ejector branching from the supply flowpath downstream of the mechanical pump and extending to the motive flow inlet of the second ejector;
a suction flowpath of the second ejector extends from the second heat exchanger to the suction flow inlet of second ejector; and
an outlet flowpath of the second ejector feeds back from the outlet of second ejector to the suction flow inlet of the first ejector.

12. The vapor compression system of claim 11 wherein:
the motive flow inlet of the first ejector receives fluid from the first heat exchanger; and
the outlet flow path of second ejector feeds back to the first heat exchanger.

13. The vapor compression system of claim 11 wherein:
the motive flow inlet of the first ejector receives fluid from a sump of the first heat exchanger; and
the outlet flowpath of second ejector feeds back to the sump.

14. A vapor compression system comprising:
a compressor comprising:
a housing assembly having a suction port and a discharge port and a motor compartment;
an electric motor having a stator within the motor compartment and a rotor within the stator, the rotor being mounted for rotation about a rotor axis;
one or more working elements coupled to the rotor to be driven by the rotor in at least a first condition so as to draw fluid in through the suction port and discharge said fluid out from the discharge port;
one or more bearings supporting the rotor and/or the one or more working elements, and
one or more bearing feed passages coupled to the one or more bearings to pass fluid along a supply flowpath to the one or more bearings;
a mechanical pump positioned to drive fluid along the supply flowpath to the one or more bearings;
a first heat exchanger downstream of the discharge port along a refrigerant primary flowpath in a first operational mode;
an expansion device downstream of the first heat exchanger along the primary flowpath in the first operational mode; and
a second heat exchanger downstream of the expansion device and coupled to the suction port to return refrigerant in the first operational mode;
an ejector having:
a motive flow inlet, coupled to the mechanical pump to receive refrigerant from the mechanical pump;
a suction flow inlet; and
an outlet; and
a controller configured to:
start the mechanical pump prior to starting the compressor; and
turn off the mechanical pump and leave the compressor running when a threshold condition has been sensed.

15. A method for operating a vapor compression system, the vapor compression system comprising:
a compressor comprising:
a housing assembly having a suction port and a discharge port and a motor compartment;

an electric motor having a stator within the motor compartment and a rotor within the stator, the rotor being mounted for rotation about a rotor axis;

one or more working elements coupled to the rotor to be driven by the rotor in at least a first condition so as to draw fluid in through the suction port and discharge said fluid out from the discharge port;

one or more bearings supporting the rotor and/or the one or more working elements, and one or more bearing feed passages coupled to the one or more bearings to pass fluid along a supply flowpath to the one or more bearings;

a mechanical pump positioned to drive fluid along the supply flowpath to the one or more bearings;

a first heat exchanger downstream of the discharge port along a refrigerant primary flowpath in a first operational mode;

an expansion device downstream of the first heat exchanger along the primary flowpath in the first operational mode; and a second heat exchanger downstream of the expansion device and coupled to the suction port to return refrigerant in the first operational mode; and an ejector having:

a motive flow inlet, coupled to the mechanical pump to receive refrigerant from the mechanical pump;

a suction flow inlet; and an outlet, the method comprising:

starting the mechanical pump;

after the starting of the mechanical pump, starting the electric motor to draw the fluid in through the suction port and discharge the fluid from the discharge port; and turning the mechanical pump off while continuing to run the electric motor.

16. The method of claim 15 wherein:

the electric motor is started after a first threshold condition is sensed; and the mechanical pump is turned off after a second threshold condition is sensed.

17. The method of claim 15 further comprising:

monitoring a flow or pressure parameter; and responsive to the said flow or pressure parameter indicating an insufficiency of flow, restarting the mechanical pump while continuing the run the electric motor.

18. The method of claim 15 further comprising:

restarting the mechanical pump while continuing to run the electric motor;

turning the electric motor off while continuing to run the mechanical pump; and turning the mechanical pump off after turning the motor off.

* * * * *